United States Patent [19]

Goss

[11] Patent Number: 4,552,794

[45] Date of Patent: Nov. 12, 1985

[54] COMPOSITION FOR TUFTED CARPETS CONTAINING AZIDOSULFONYL SILANE CROSSLINKER

[75] Inventor: Raymond W. Goss, Newark, Del.

[73] Assignee: Hercules Incorporated, Wilmington, Del.

[21] Appl. No.: 642,612

[22] Filed: Aug. 20, 1984

Related U.S. Application Data

[62] Division of Ser. No. 509.747, Jun. 30, 1983, Pat. No. 4,501,846.

[51] Int. Cl.[4] ..... B32B 3/02; B32B 33/00; C08K 5/01

[52] U.S. Cl. ..... 428/95; 428/96; 428/97; 524/476

[58] Field of Search ..... 428/95, 96, 97; 524/476

[56] References Cited

U.S. PATENT DOCUMENTS

| | | | |
|---|---|---|---|
| 3,390,035 | 6/1968 | Sands | 156/72 |
| 3,551,231 | 12/1970 | Smedberg | 156/72 |
| 3,583,936 | 6/1971 | Stahl | 260/28.5 |
| 3,676,280 | 7/1972 | Sands | 161/67 |
| 3,684,600 | 8/1972 | Smedberg | 156/93 |
| 3,745,054 | 7/1973 | Smedberg | 161/67 |
| 3,770,558 | 11/1973 | Stahl | 161/65 |
| 3,911,185 | 10/1975 | Wright, Jr. | 428/97 |
| 3,914,489 | 10/1975 | Smedberg | 428/97 |
| 4,012,547 | 3/1977 | Smedberg | 428/97 |

*Primary Examiner*—Marion E. McCamish
*Attorney, Agent, or Firm*—Joanne L. Horn

[57] ABSTRACT

Disclosed is a pre-coat composition consisting essentially of (1) a low density polyethylene having a melt index of from about 70 to about 425; (2) a nitrogen-containing silane cross-linking compound, (3) a resin having a Ring and Ball softening point from about 50° C. to about 115° C.; (4) a hydrocarbon wax; and (5) optionally naphthenic oil. The composition is useful in the manufacture of tufted carpets.

15 Claims, No Drawings

COMPOSITION FOR TUFTED CARPETS CONTAINING AZIDOSULFONYL SILANE CROSSLINKER

This application is a division, of application Ser. No. 509,747, filed June 30, 1983, now U.S. Pat. No. 4,501,846, filed Feb. 26, 1985.

This invention relates to chemical compositions. Particularly, this invention relates to novel precoat compositions useful in the manufacture of tufted textile articles, such as, tufted carpets.

BACKGROUND OF THE INVENTION

Tufted textile articles are made by inserting a plurality of vertical, reciprocating needles threaded with yarn into a moving primary backing fabric to form tufts of yarn. Loopers or hooks, which work in a timed relationship with the stroke of the needles, are located below the primary backing so that the loopers are positioned just above the needle eye when the needles are at the lowest point in their downward stroke. When the needles reach the lowest point in the downward stroke, the yarn is picked up from the needles by the loopers and held momentarily. Loops or tufts of yarn are formed as the needles are drawn back through the backing fabric. This process is repeated when the previously formed loops are moved away from the loopers as the backing fabric is advanced.

The loops can be cut during the tufting process to form a cut pile as opposed to a loop pile construction. If a cut pile is desired, a looper and knife combination is used in the tufting process.

Additional information on the manufacture of tufted articles may be found in Rose, Stanley H., "Tufted Materials", Man-Made Textile Encyclopedia, Chap IX, Textile Book Publishers, Inc., (1959).

When the tufted article is a carpet, the primary backing fabric is typically a woven or nonwoven fabric made of one or more of natural and synthetic fibers, such as jute, wool, rayon, polyamides, polyesters, polypropylene and polyethylene, or of films of synthetic materials, such as polypropylene, polyethylene, and copolymers thereof.

The tufts of yarn inserted during the tufting process are usually held in place by the untwisting action of the yarn in combination with the shrinkage of the backing fabric. However, when the article is a tufted carpet, the back of the backing fabric may be coated with a backcoat material, such as a latex or emulsion of natural or synthetic rubbers or synthetic resins, or a hot melt adhesive, to assist in locking or anchoring the tufts to the backing material, to improve the dimensional stability of the tufted carpet, to make the carpet more durable and to provide skid and slip resistance.

Generally, the tufted carpet is further stabilized by laminating a secondary backing, such as jute, woven or nonwoven fabrics made from polypropylene, polyethylene, and copolymers thereof, to the tufted carpet. When the backcoating material is a hot melt adhesive, the adhesive helps bond the primary backing fabric to the secondary backing fabric.

Carpets bonded with a hot melt adhesive generally use a pre-coat composition comprising a resin, a wax, and optionally, a naphthenic oil, which is applied to the primary backing prior to backcoating the backing fabric with the hot melt adhesive. The precoat is applied in an amount sufficient to penetrate the individual tufts of yarn thereby increasing the resistance of the tufts to pull-out, known as tuft-bond strength or pile-bond strength, and enhancing the bonding of the primary backing fabric to the backcoating adhesive. The amount of precoat necessary to penetrate the individual tufts will vary depending on the carpet yarn density and the efficacy of the precoat.

SUMMARY OF THE INVENTION

A pre-coat composition has now been found which improves the tuft-bond strength, narrows the statistical variation of tuft bond values and increases the stiffness and durability of the carpet. The mechanism by which the unique and unexpected effect of this invention takes place is believed to be that the nitrogen-containing silane cross-linking compound, in particular the nitrogen-containing moiety, first bonds to the low density polyethylene. Then the silane-containing moiety bonds to the components of the formulation, the primary backing fabric, the secondary backing fabric, to any fillers in the hot melt adhesive backcoat, or to combinations thereof, during or after the application of the precoat to the carpet, as a result of the reaction with moisture from the steaming of the carpet prior to drying or by absorption of moisture from the air on storage. This improves the bond strength and the retention of strength on ageing of the carpet during use, particularly in a humid atmosphere.

According to the present invention, a pre-coat composition is provided having a Brookfield viscosity of from about 25 to about 500 centipoise at about 150° C. which comprises, by weight, (1) from about 1% to about 19% of a low density polyethylene; (2) from about 0.1% to about 5% of a nitrogen-containing silane cross-linking compound; (3) from about 65% to about 85% of a resin; (4) from about 5% to about 7% of a hydrocarbon wax; and (5) optionally, up to about 30% of a naphthenic oil; the total of (1), (2), (3), (4) and (5) being 100%.

Preferably the composition of this invention has a Brookfield viscosity of from about 70 to about 240 centipoise at 150° C.

In another aspect of the present invention, the precoat composition can be used in the manufacture of hot melt adhesive materials used to backcoat the tufted primary backing fabric prior to lamination with the secondary backing fabrics. Typically, such adhesives are based either on an ethylene-vinyl acetate copolymer or an amorphous homopolymer or copolymer of propylene or mixtures thereof. Generally, the ethylene-vinyl acetate copolymer has a polymerized vinyl acetate content, by weight of the copolymer, of from about 18% to about 33%, preferably from about 18% to about 28%. Typically the amorphous homopolymers and copolymers of propylene have a Ring & Ball softening point from about 105° C. to about 155° C. Generally, the hot melt adhesive contains from about 15% to about 40% of a polymeric material, from about 20% to about 60% of a resinous material, and up to 65% of a mineral filler. Up to about 60% of the pre-coat composition of this invention can be used in the preparation of such hot melt adhesives, preferably from about 40% to about 50%.

All parts and percentages used in this disclosure are by weight of the total composition unless otherwise indicated.

Component (1) of the pre-coat composition of this invention is a low density or linear low density polyethylene having a melt index of from about 70 to about 425, preferably from about 100 to about 200.

Component (2) of the pre-coat composition of this invention is a nitrogen-containing silane compound having the general formula $$X_3—Si—R—Z$$

where R is an organic radical, X is selected from halo, hydroxy, alkoxy, aryloxy, organo oxycarbonyl, azido, amine, and amide radicals; and Z is selected from $$—O—\overset{\overset{\displaystyle O}{\|}}{C}—\overset{\overset{\displaystyle R'}{|}}{C}N_2,\ —O\overset{\overset{\displaystyle O}{\|}}{C}N_3,\ \text{and}\ —SO_2N_3;$$

where R′ is selected from hydrogen, alkyl, cycloalkyl, aryl and —COOR″ radicals; where R″ is selected from alkyl, cycloalkyl, and aryl radicals.

Generally, R will be selected from the group consisting of the hydrocarbon, halo-substituted hydrocarbon, hydrocarbon-oxy-hydrocarbon, hydrocarbon-thiohydrocarbon and hydrocarbon-sulfonyl-hydrocarbon divalent radicals, which radicals can be optionally substituted with other functional groups, that are substantially inert to the reactions and the reaction conditions under which these compounds are used, such as esters, sulfonate esters, amides, sulfonamides, urethanes, and the like. In preferred embodiments of this invention R will be a divalent organic radical, optionally substituted with other functional groups as previously mentioned, selected from the group consisting of alkylene radicals such as the straight and branched $C_1$–$C_{20}$ alkylene radicals which include, for instance, the methylene, ethylene, trimethylene, tetramethylene, pentamethylene, hexamethylene, octamethylene, decamethylene, dodecamethylene, octadecamethylene, etc. radicals; cycloalkylene radicals such as the $C_3$–$C_{20}$ cycloalkylene radicals which include, for instance, the cyclohexylene, cyclopentylene, cyclooctylene, cyclobutylene, etc. radicals; arylene radicals such as o-,m-, and p-phenylene, naphthalene, biphenylene, etc. radicals; arylene-dialkylene radicals, such as o-, m-, and p-xylylene diethylene, o-, m-, and p-phenylene diethylene, etc. radicals; alkylene-diarylene radicals such as methylene bis(o-, m- and p-phenylene), ethylene bis(o-, m-, and p- phenylene), etc. radicals; cycloalkylene-dialkylene radicals such as 1,2-, 1,3-and 1,4-cyclohexane-dimethylene, 1,2- and 1,3-cyclopentane dimethylene, etc. radicals; and the alkyleneoxy-alkylene radicals, arylene-oxy-arylene radicals, alkarylene-oxy-arylene radicals, alkarylene-oxy-alkarylene radicals, aralkylene-oxy-alkylene radicals, aralkylene-oxy-aralkylene radicals, etc. as well as the corresponding thio and sulfonyl radicals, specific examples of which included ethylene-oxy-ethylene, propylene-oxy-butylene, phenylene-oxy-phenylene, methylenephenylene-oxy-phenylenemethylene, phenylenemethylene-oxy-methylenephenylene, ethylene-thioethylene, phenylene-thio-phenylene, phenylememethylene-thio-methylenephenylene, butylene-sulfonyl-butylene, etc. radicals.

The most preferred R′ radicals are alkyl, cycloalkyl and aryl radicals are methyl, ethyl, propyl, butyl, isobutyl, cyclohexyl, cycloheptyl, phenyl, tolyl, etc. Typically, the R″ radicals are methyl, ethyl, propyl, butyl, isobutyl, cyclohexyl, cycloheptyl, phenyl tolyl, etc.

In general X can be hydroxy or any hydrolyzable radical. Typical hydrolyzable radicals are the halo radicals which include, for instance, the fluoro, chloro, bromo and iodo radicals; the alkoxy radicals including the $C_1$–$C_{20}$ straight and branched chain alkoxy radicals such as methoxy, ethoxy, propoxy, butoxy, isobutoxy, octadecyloxy, etc.; the aryloxy radicals such as phenoxy, etc.; the organo oxycarbonyl radicals including the aliphatic oxycarbonyl radicals such as acetoxy, propionyloxy, stearoyloxy, etc.; the cycloaliphatic oxycarbonyl radicals such as cyclohexylcarbonyloxy, etc.; the aromatic oxycarbonyl radicals such as benzoyloxy, xylyloxy, etc.; the azido radical; the amine radical; the substituted amine radicals such as ethylamine, diethylamine, propylamine, etc.; and the amide radicals such as formamide, acetamide, trifluoroacetamide, benzamide, etc.

Preferably, the nitrogen-containing silane cross-linking compound, component (2), is an azidosulfonyl silane. Suitable azidosulfonyl silanes include 4-(azidosulfonyl)4′-(trialkoxysilyl)propyl diphenylether, such as 4-(azidosulfonyl)-4′(triethoxysilyl)propyl diphenylether; azidosulfonylalkyl(trialkoxy)silane, such as azidosulfonyl hexyl(triethoxy)silane; and trialkoxysilylalkylbenzenesulfonyl azide such as trimethoxysilylethylbenzenesulfonyl azide.

The nitrogen-containing silanes can be prepared by any of the methods disclosed in U.S. Pat. No. 3,697,551 or by the reaction of a diaryl (alkyl) ether disulfonyl chloride with a substituted alkyltrialkoxy silane with subsequent conversion to an azidosilane by known methods.

Component (3) of the pre-coat composition of this invention is a resin having a Ring and Ball softening point from about 50° C. to about 115° C. Suitable resins include hydrocarbon resins prepared by polymerizing the component mixture of a five carbon to nine carbon stream from petroleum refining, commonly referred to as a $C_5$–$C_9$ stream. Hence, the resins prepared from such a stream are commonly referred to as $C_5$–$C_9$ resins. The components of a $C_{5-C9}$ stream are aliphatic and aromatic hydrocarbon compounds, both normal and branched, in which the number of carbons does not exceed nine. Other suitable resins include hydrocarbon resins prepared by polymerizing the monomer mixture of a five carbon component stream, known as a $C_5$ stream, from petroleum refining, the monomers being primarily aliphatic. The resins prepared from a $C_5$ stream are commonly referred to as $C_5$ resins. The primary monomers present in a $C_5$ stream are di- and mono-olefins, both normal and branched, having five carbons and mono-olefins have six carbons. The preferred resin is the $C_5$–$C_9$ resin. In addition, polyterpene resins derived from alpha-pinene, beta-pinene, and monocyclic terpenes such as dipentene; and esters of rosin, such as the methyl ester of rosin, the methyl ester of hydrogenated rosin, the triethylene glycol ester of rosin, the triethylene glycol ester of hydrogenated rosin, the diethylene glycol ester of rosin, the diethylene glycol ester of hydrogenated rosin, the ethylene glycol ester of rosin and the ethylene glycol ester of hydrogenated rosin, the glycerol ester of rosin and the pentaerythritol ester of rosin.

Component (4) of the pre-coat composition of this invention is a hydrocarbon wax having a melting point of from about 105° C. to about 125° C., preferably from about 108° C. to about 118° C., and a molecular weight of from about 500 to about 8000, preferably from about 1500 to about 2500. Suitable waxes for this purpose are the synthetic waxes, such as homopolymers of ethylene, having a viscosity of from about 30 cps. to about 80 cps. at 149° C.

Component (5) of the pre-coat composition of this invention is a naphthenic oil. Naphthenic oil contains hydrocarbons of high molecular weight in the form of a heavy, viscous, transparent, odorless liquid of low volatility and has a specific gravity of from about 0.8990 to about 0.9315 and a Saybolt Universal viscosity at 38° C. of from about 40 to 2000, preferably about 400 seconds to about 600 seconds.

Preferably the pre-coat composition of this invention comprises from about 3% to about 12% of component (1); from about 0.5% to about 3% of component (2); from about 65% to about 85% of component (3); from about 5% to about 7% of component (4); and from about 10% to about 30% of component (5).

In addition, small amounts of conventional additives, such as antioxidants, fillers and the like can be included in the composition.

DESCRIPTION OF PREFERRED EMBODIMENTS

The following examples illustrate aspects of this invention. They are not intended to limit the invention. Modifications of the specific pre-coat compositions, hot melt adhesive materials, tufted carpets and procedures of these examples can be made without departing from the spirit and scope of this invention.

EXAMPLE 1

This example illustrates a preferred specific embodiment of the composition of this invention, and how to prepare it.

Nine % of a low density polyethylene in pellet form having a melt index of 150, and 2% of a 50% solution of azidosulfonylhexyl(triethoxy)silane ("silane") in methylene chloride are placed in a tumble drier and tumble dried at ambient temperature for about two hours or until all the methylene chloride is evaporated to provide 10% of a dry silane-coated polyethylene material.

The 10% dried silane-coated polyethylene material is placed in the hopper of an extruder and melt blended at a temperature of about 131° C. for a first pass through the extruder. The melt blended material is collected from the orifice of the extruder and placed in the hopper of the extruder again for a second pass through the extruder at a temperature of 160° C. The resulting material is then pelletized with the use of air drying devices instead of the conventional water bath to crystallize the polymer. The use of a water bath is avoided in order to prevent premature moisture-initiated coupling or bonding through the silyl group.

In a tank equipped with an agitator and heated with steam at a temperature of about 150° C., a resin blend is prepared by blending 70.2% of a $C_5$–$C_9$ resin having a Ring and Ball s. pt. of 60° C.; 5.4% polyethylene wax having a melting point of 115° C. and a molecular weight of 2000; and 14.4% of a naphthenic oil having a specific gravity of 0.9000 and a S.U. viscosity at 38° C. of 500 sec.

The silane-bonded polyethylene pellets (10%) are then added to the tank containing the resin blend and mixed until a homogeneous blend is obtained.

EXAMPLE 2

This example illustrates another specific embodiment of this invention. The composition is prepared according to the procedure of Example 1.

The formulation of the composition is set forth in Table I.

TABLE I

| Components | Percent |
|---|---|
| 4-(azidosulfonyl)-4'-(triethoxysilyl) propyldiphenylether bonded low density polyethylene having a melt index of 150. | 10.0 |
| $C_5$ resin (Ring & Ball s. pt. 95° C.). | 70.4 |
| Naphthenic oil (sp. grav. 0.9000; S.U. viscosity at 38° C. 500 sec.) | 14.2 |
| Polyethylene wax (m. pt. 115° C.) | 5.4 |

EXAMPLE 3

This example illustrates another embodiment of this invention. The composition is prepared according to Example 1 except that 3-(methyldimethoxysilyl)propyl azidoformate is used instead of azidosulfonylhexyl(triethoxy)silane.

EXAMPLE 4

This example illustrates another embodiment of this invention. The composition is prepared according to the procedure of Example 1 using the formulation of Table I except that 3-(methyldimethoxysilyl)propyl azidoformate is used instead of 4-(azidosulfonyl)-4'-(triethyloxysilyl)propyldiphenyl ether.

EXAMPLE 5

This example illustrates another embodiment of this invention. The composition is prepared according to Example 1 except that 3-(trimethoxysilyl)propyl diazoacetate is used instead of azidosulfonylhexyl(triethoxy)silane.

EXAMPLE 6

This example illustrates another embodiment of this invention. The composition is prepared according to the procedure of Example 1 using the formulation of Table I except that 3-(trimethoxysilyl)propyl diazoacetate is used instead of 4-(azidosulfonyl)-4'-(triethyloxysilyl)propyldiphenyl ether.

EXAMPLE 7

This example illustrates another embodiment of this invention, and how to prepare it.

Forty-eight % of the pre-coat composition of Example 1 and 22% of an ethylene-vinyl acetate copolymer having a polymerized vinyl acetate content of 19%, by weight of the copolymer, are melt blended in a container by aerating at 160° C. Thirty % of a calcium carbonate filler is then added to the melt blend to provide a hot melt adhesive material.

EXAMPLE 8

This example shows that tuft bond strength of finished carpets prepared with the precoat composition of this invention and an ethylene-vinyl acetate copolymer-based hot melt adhesive material containing the pre-coat composition of this invention as the backcoat.

Carpet specimens are prepared according to the precedures of ANSI/ASTM D1335-67 using 10 oz./yd.$^2$ of the composition of Example 1 as the pre-coat at 155° C. and then applying 24 oz./yd.$^2$ of the hot melt adhesive material of Example 7 as the backcoat (Test specimen 1) and, as the control, 10 oz./yd.$^2$ of the composition of Example 1 as the pre-coat and applying 24 oz./yd.$^2$ of the hot melt adhesive material of Example 7 as the backcoat, both of which are minus the 10% silane-coated polyethylene material (Test specimen 2). The carpet test specimens were mounted and tested for tuft bond strength according to ANSI/ASTM D1335-67. Basically, this test measures the amount of force required to separate individual pile yarns from the carpet. The results of the test are tabulated below:

| | Test Specimens | |
|---|---|---|
| | 1 | 2 |
| Tuft bond strength, lbs. | | |
| Initial | 17.9 | 15.0 |
| 7 days | 20.2 | 18.1 |
| 14 days | 23.1 | 17.2 |

*Stored at 23° C. and 50% relative humidity.

EXAMPLE 9

This example illustrates another embodiment of this invention. A hot melt adhesive material is prepared according to the procedure of Example 7 using 25% of the pre-coat composition of Example 1 except that a $C_5$ resin is used instead of the $C_5$–$C_9$ resin, 45% of an amorphous polymer of propylene having a Ring & Ball softening point of 150° C., and 30% of a calcium carbonate filler.

EXAMPLE 10

This example shows the tuft bond strength of finished carpets prepared with the precoat composition of this invention, and a hot melt adhesive material based on an amorphous polymer of propylene containing the precoat composition of this invention as the backcoat.

Carpet specimens are prepared according to the procedures of ANSI/ASTM D1335-67 using 10 oz./yd.$^2$ of the composition of Example 2 as the pre-coat and then applying 24 oz./yd.$^2$ of the hot melt adhesive material of Example 9 as the backcoat (Test specimen 3) and, as the control, 10 oz./yd.$^2$ of the precoat composition of Example 2 as the pre-coat and then applying 24oz./yd.$^2$ of the hot melt adhesive material of Example 9 as the backcoat, both of which are minus the 10% silane-coated polyethylene material (Test specimen 4). The carpet test specimens were mounted and tested for tuft bond strength according to ANSI/ASTM D1335-67. The results of the test are tabulated below:

| | Test Specimens | |
|---|---|---|
| | 3 | 4 |
| Tuft bond strength, lbs. | | |
| Initial | 17.1 | 15.0 |
| 7 days | 22.1 | 18.1 |
| 14 days | 24.1 | 17.2 |

Other features, advantages and specific embodiments of this invention will become apparent to those exercising ordinary skill in the art after reading the foregoing disclosures. Such specific embodiments are within the scope of this invention. Moreover, while specific embodiments of the invention have been described in considerable detail, it is not limited thereto, and variations and modifications of those embodiments can effected without departing from the spirit and scope of the invention.

What I claim and desire to secure by Letters Patent is:

1. In a hot melt adhesive material having a polymer selected from the group consisting of ethylene-vinyl acetate copolymers, amorphous polypropylenes and amorphous propylene copolymers, the improvement which comprises the addition of from about 40% to about 60% of a composition having a Brookfield viscosity of from about 25 to about 500 centipoise at about 150° C. comprising, by weight:

(a) from about 1% to about 19% of a low density polyethylene having a melt index of from about 70 to about 425;

(b) from about 0.1% to about 5% of a nitrogen-containing silane cross-linking compound having the general formula $$X_3—Si—R—Z$$

where R is an organic radical, X is selected from halo, hydroxy, alkoxy, aryloxy, organo oxycarbonyl, azido, amine, and amide radicals; and Z is selected from $$-O-\overset{\overset{\displaystyle O}{\|}}{C}-\overset{\overset{\displaystyle R'}{|}}{C}N_2,\ -O\overset{\overset{\displaystyle O}{\|}}{C}N_3,\ \text{and}\ -SO_2N_3;$$

where R′ is selected from hydrogen, alkyl, cycloalkyl, aryl and —COOR″ radicals; where R″ is selected from alkyl, cycloalkyl, and aryl radicals;

(c) from about 65% to about 85% of a resin having a Ring and Ball softening point of from about 50° C. to about 115° C. selected from the group consisting of hydrocarbon resins and esters of rosin;

(d) from about 5% to about 7% of a hydrocarbon wax; and (e) up to about 30% of a naphthenic oil.

2. The hot melt adhesive material of claim 1 wherein the polymer is an ethylene-vinyl acetate copolymer.

3. The hot melt adhesive material of claim 1 wherein the polymer is an amorphous polypropylene.

4. The hot melt adhesive material of claim 1 wherein the polymer is an amorphous propylene copolymer.

5. The composition of claim 1 wherein component (b) is 4-(azidosulfonyl)-4′-(triethoxysilyl)propyl-di-phenyl ether.

6. The composition of claim 1 wherein component (c) is a hydrocarbon resin.

7. The composition of claim 1 wherein component (e) is present in an amount from about 20% to about 30%.

8. A carpet comprising:

(a) a primary backing fabric stitched with loops of yarn on the frontside of the primary backing fabric to form a tufted structure;

(b) a composition comprising (i) from about 1% to about 19% of a low density polyethylene having a melt index of from about 70 to about 425;

(ii) from about 0.1% to about 5% of a nitrogen-containing silane cross-linking compound having the general formula $$X_3—Si—R—Z$$

where R is an organic radical, X is selected from halo, hydroxy, alkoxy, aryloxy, organo oxycarbonyl, azido, amine, and amide radicals; and Z is selected from $$-O-\overset{O}{\overset{\|}{C}}-\overset{R'}{\overset{|}{C}}N_2,\ -\overset{O}{\overset{\|}{O}}CN_3,\ \text{and}\ -SO_2N_3;$$

where R′ is selected from hydrogen, alkyl, cycloalkyl, aryl and —COOR″ radicals; where R″ is selected from alkyl, cycloalkyl, and aryl radicals;

(iii) from about 65% to about 85% of a resin having a Ring and Ball softening point of from about 50° C. to about 115° C. selected from the group consisting of hydrocarbon resins and esters of rosin;

(iv) from about 5% to about 7% of a hydrocarbon wax; and (v) up to about 30% of a naphthenic oil coated on the backside of the primary backing fabric;

(c) a hot melt adhesive material as recited in claim 1 applied over the composition; and (d) a secondary backing fabric securely applied to the hot melt adhesive material.

9. In a hot melt adhesive material having a polymer selected from the group consisting of ethylene-vinyl acetate copolymers, amorphous polypropylenes and amorphous propylene copolymers, the improvement which comprises the addition of from about 50% to about 60% of a composition having a Brookfield viscosity of from about 25 to about 500 centipoise at about 150° C. comprising, by weight:

(a) from about 3% to about 12% of a low density polyethylene having a melt index of from about 100 to about 200;

(b) from about 0.5% to about 3% of a nitrogen-containing silane cross-linking compound having the general formula $$X_3-Si-R-Z$$

where R is an organic radical, X is selected from halo, hydroxy, alkoxy, aryloxy, organo oxycarbonyl, azido, amine, and amide radicals; and Z is selected from $$-O-\overset{O}{\overset{\|}{C}}-\overset{R'}{\overset{|}{C}}N_2,\ -\overset{O}{\overset{\|}{O}}CN_3,\ \text{and}\ -SO_2N_3;$$

where R′ is selected from hydrogen, alkyl, cycloalkyl, aryl and —COOR″ radicals; where R″ is selected from alkyl, cycloalkyl, and aryl radicals;

(c) from about 65% to about 85% of a resin having a Ring and Ball softening point of from about 50° C. to about 115° C. selected from the group consisting of hydrocarbon resins and esters of rosin;

(d) from about 5% to about 7% of a hydrocarbon wax; and (e) from about 10% to about 30% naphthenic oil.

10. The hot melt adhesive material of claim 9 wherein the polymer is an ethylene-vinyl acetate copolymer.

11. The hot melt adhesive material of claim 9 wherein the polymer is an amorphous polypropylene.

12. The hot melt adhesive material of claim 9 wherein the polymer is an amorphous propylene copolymer.

13. The composition of claim 9 wherein component (b) is azidosulfonylhexyl(triethoxy)silane.

14. The composition of claim 9 wherein component (c) is a hydrocarbon resin.

15. A carpet comprising:

(a) a primary backing fabric stitched with loops of yarn on the frontside of the primary backing fabric to form a tufted structure;

(b) a composition comprising (i) from about 3% to about 12% of a low density polyethylene having a melt index of from about 100 to about 200;

(ii) from about 0.5% to about 3% of a nitrogen-containing silane cross-linking compound having the general formula $$X_3-Si-R-Z$$

where R is an organic radical, X is selected from halo, hydroxy, alkoxy, aryloxy, organo oxycarbonyl, azido, amide, and amide radicals; and Z is selected from $$-O-\overset{O}{\overset{\|}{C}}-\overset{R'}{\overset{|}{C}}N_2,\ -\overset{O}{\overset{\|}{O}}CN_3,\ \text{and}\ -SO_2N_3;$$

where R′ is selected from hydrogen, alkyl, cycloalkyl, aryl and —COOR″ radicals; where R″ is selected from alkyl, cycloalkyl, and aryl radicals;

(iii) from about 65% to about 85% of a resin having a Ring and Ball softening point of from about 50° C. to about 115° C. selected from the group consisting of hydrocarbon resins and esters of rosin;

(iv) from about 5% to about 7% of a hydrocarbon wax; and (v) from about 10% to about 30% naphthenic oil coated on the backside of the primary backing fabric;

(c) a hot melt adhesive material as recited in claim 9 applied over the composition; and (d) a secondary backing fabric securely applied to the hot melt adhesive material.

* * * * *